United States Patent [19]

Frazier et al.

[11] Patent Number: 4,538,534

[45] Date of Patent: Sep. 3, 1985

[54] APPARATUS AND METHOD FOR PROCESSING HOSIERY BLANKS

[75] Inventors: Estill G. Frazier, Colfax; William P. Kiger, Jr., Greensboro, both of N.C.

[73] Assignee: Kayser-Roth Hosiery, Inc., Burlington, N.C.

[21] Appl. No.: 608,361

[22] Filed: May 9, 1984

[51] Int. Cl.[3] ..... D05B 97/00; D05B 21/00

[52] U.S. Cl. ..... 112/262.2; 112/121.15; 112/290

[58] Field of Search ..... 112/121.15, 121.29, 112/121.12, 121.11, 2, 262.2, 262.3, 290; 223/43

[56] References Cited

U.S. PATENT DOCUMENTS

| | | | |
|---|---|---|---|
| 3,859,938 | 1/1975 | Fukuyama | 112/121.15 |
| 3,900,899 | 8/1975 | Bailey | 112/121.15 X |
| 3,952,673 | 4/1976 | Fukuyama | 112/121.15 |
| 4,133,280 | 1/1979 | Takatori et al. | 112/121.15 X |
| 4,364,320 | 12/1982 | Nakhle | 112/262.2 |
| 4,383,490 | 5/1983 | Hodges | 112/121.15 |

*Primary Examiner*—H. Hampton Hunter

*Attorney, Agent, or Firm*—Bell, Seltzer, Park & Gibson

[57] ABSTRACT

A hosiery toe closing machine is provided with automatic hosiery donning means for drawing successive hosiery blanks onto successive hosiery carriers as they move into position at a hosiery receiving station of the hosiery toe closing machine. A hot wire slitter is also provided at the hosiery receiving station for longitudinally slitting the leading end of the hosiery blank as it is automatically drawn onto the hosiery carrier. The hosiery donning and slitting devices permit the economical processing of hosiery blanks in preparation for forming pantyhose therefrom.

14 Claims, 9 Drawing Figures

APPARATUS AND METHOD FOR PROCESSING HOSIERY BLANKS

FIELD OF THE INVENTION

This invention relates generally to an apparatus and method for processing hosiery blanks for subsequent formation of pantyhose, and more particularly to the processing of hosiery blanks on an automatic toe closing machine which includes a hosiery blank donning device for automatically drawing successive hosiery blanks onto elongate tubular hosiery carriers which are moved around an endless path. The hosiery blanks are everted as they are drawn onto the hosiery carriers and the upper ends contact a slitter so that the upper ends of each of the hosiery blanks are automatically slit.

BACKGROUND OF THE INVENTION

In the formation of pantyhose from a pair of elongate seamless hosiery blanks, it is the usual practice to knit seamless tubular hosiery blanks in right side out condition, transfer the knit blanks to a first sewing operator where the blanks are everted, inspected and the toe ends are closed by a seaming operation. The blanks are then transported to another operator where the upper ends are slit in a longitudinal direction and the slit edges of adjacent pairs of hosiery blanks are seamed together to form the panty portion, with or without a crotch insert or a connecting panel, to complete the pantyhose. This usual method of producing pantyhose requires several handling operations at different locations, thereby increasing the production cost, and also increasing the likelihood of the formation of picks and snags in the hosiery blanks and finished pantyhose.

In an attempt to increase efficiency and reduce cost, several different types of automatic toe closing machines have been developed which include a plurality of elongate hosiery carriers mounted on rotary turrets or trackways and movable around an endless path. With this type of machine, the operator merely needs to don the hosiery blanks on successive hosiery carriers and they are transported to a sewing machine where the toe end is automatically closed and the hosiery blank is subsequently removed by suction currents withdrawing the hosiery blank through the elongate hosiery carrier to evert the hosiery blank back to a right side out condition with the seam of the toe positioned on the inside of the hosiery blank. Hosiery blank toe closers of this general type are illustrated in numerous patents including U.S. Pat. Nos. 3,420,196; 3,952,673; 4,120,251; and 4,383,490.

While these machines do reduce the labor costs involved in closing the toes of the hosiery blanks, the upper ends of the hosiery blanks must still be longitudinally slit in a separate operation.

U.S. Pat. Nos. 3,900,899 and 3,941,285 respectively disclose a method and apparatus for producing pantyhose which includes a single elongate tubular hosiery everting and inspection form with a toe seaming machine positioned closely adjacent the free end of the tubular form. The form is provided with a slitting device and the operator manually dons the upper end of the hosiery blank onto the inspection form so that a longitudinal slit is formed as the upper end is manually drawn onto the hosiery form to a predetermined point. The toe end is then seamed closed and the closed hosiery blank is then withdrawn through the elongate form by suction currents to evert the same so that it is again in right side out condition with the toe seam on the inside of the hosiery blank. While the method and apparatus disclosed in these patents do effect some cost savings by providing the slitting of the upper end of the hosiery blank and the toe closing in sequential operations by a single operator, the individual hosiery blanks are still manually drawn onto the hosiery form, the toe closure seam is manually formed, and the length of the longitudinal slit depends upon the skill of the operator in drawing the hosiery blank onto the elongate form and against the slitter.

SUMMARY OF THE INVENTION

With the foregoing in mind, it is an object of the present invention to provide an apparatus and method for automatically processing hosiery blanks on a hosiery toe closing machine for subsequent formation of pantyhose which reduces the cost of producing the same by reducing the number of manual handling operations to thereby reduce the production cost and the likelihood of forming picks and snags in the pantyhose blanks.

In accordance with the present invention, the apparatus of the present invention provides an automatic hosiery donning device for drawing one end of the pantyhose blank onto the elongate tubular hosiery carrier until the desired length of slit is formed in the hosiery blank. The tubular hosiery carrier with the slit hosiery blank thereon is then moved to a seaming station where the toe end is automatically seamed and then moved to a doffing station where the hosiery blank is automatically removed by being withdrawn through the hosiery carrier and everted so that the hosiery blank is in a right side out condition with the toe seam on the inside.

The present apparatus thus automatically operates to draw the hosiery blank onto the elongate tubular hosiery carrier, slit the upper end thereof, then seam the toe end, and finally evert and doff the hosiery blank so that it is then in a condition to be seamed to another hosiery blank to complete the formation of the pantyhose.

Further, the present apparatus includes a rodless pneumatic cylinder for actuating the donning device and suitable valve means for controlling the operation of the pneumatic cylinder in response to a photocell detector operable by an integral portion of the pantyhose for terminating the operation of the donning device when the slit has been formed to the proper length. The slitting device is in the form of a heated wire and is supported for movement into and out of operative position adjacent the successive elongate tubular hosiery carriers as they are moved into position at the loading station.

Each hosiery blank includes a panty portion knit of a heavy denier yarn and a sheer leg portion knit of a light denier yarn. Successive hosiery blanks are positioned, with the panty portion at the leading end, in the donning device to be automatically drawn onto the hosiery carrier. A detector is positioned adjacent the carrier and operates when the sheer leg portion passes thereby to move the slitting device to the inoperative position. This detector cooperates with the donning and slitting devices to insure that the longitudinal slits formed in successive hosiery blanks are all of the same length so that the slit edges of pairs of the hosiery blanks can be quickly and easily sewn together.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
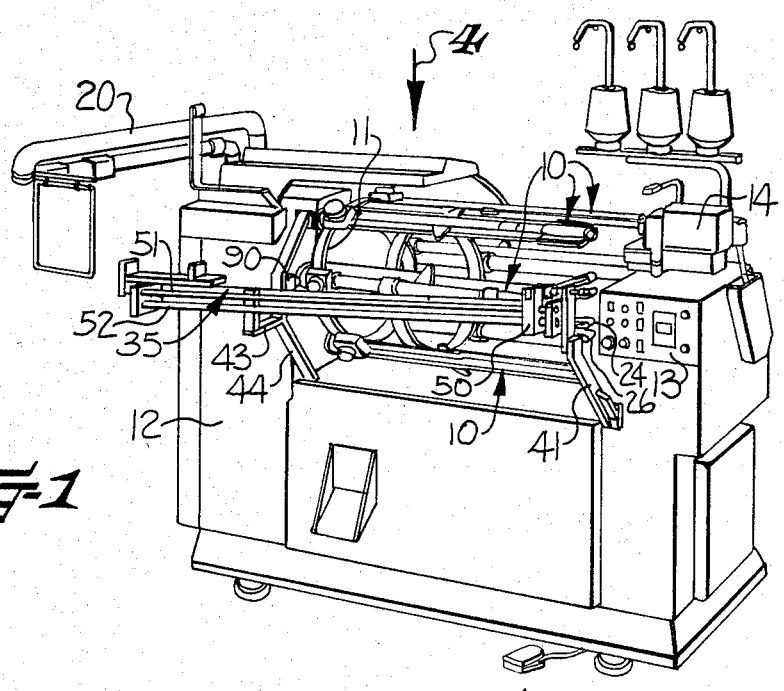
FIG. 1 is a perspective view of one side of an automatic toe closer machine with the apparatus of the present invention applied thereto.

The apparatus of the present invention is illustrated in FIG. 1 as being applied to an automatic toe closer of the type currently being manufactured and sold by Takatori as their Model TC-720A. However, it is to be understood that the apparatus of the present invention could also be applied to various other types of automatic toe closer machines presently being commercially sold.

Figure 6:
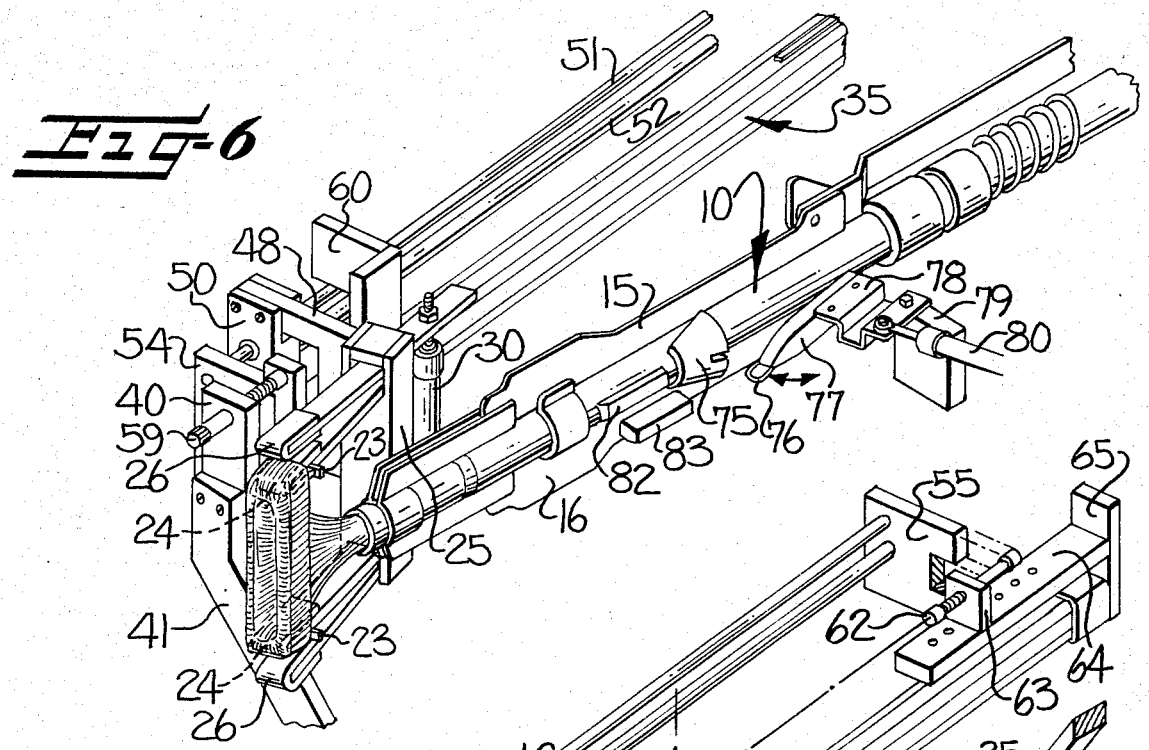
FIG. 6 is a fragmentary isometric view of the front end portion of the donning device and illustrating the manner in which the upper end of the elongate hosiery blank is manually positioned on the grippers of the donning device in preparation for an automatic slitting operation.

The conventional machine includes a plurality of elongate tubular hosiery carriers, broadly indicated at 10, and supported at their inner ends on a turret 11 for movement around an endless and oblong path of travel. The turret 11 is supported on the machine frame or housing 12 and an operator control panel 13 is provided thereon. A sewing machine 14 is supported on the housing 12 and is positioned adjacent the path of travel of the free ends of the elongate tubular hosiery carriers 10. As illustrated in FIG. 6, each of the hosiery carriers 10 is provided with a pair of hosiery spreader fins 15, 16 extending along opposite sides thereof and operable by a conventional mechanism associated with the machine for spreading the forward or toe end of the hosiery blank and positioning the same to be sewn as the corresponding tubular hosiery carrier 10 approaches and passes the sewing machine 14.

In the conventional or normal operation, an operator manually draws a stocking blank onto the hosiery carrier tube 10 each time a hosiery carrier 10 moves to a hosiery donning station located in a horizontal medial position in the front of the machine. The hosiery carrier 10 then moves in a step-by-step manner and in a clockwise direction to trim and sew the toe end of the hosiery blank as it passes the sewing machine 14. With further movement of the carrier tube 10, suction currents are provided on the inside of the carrier tube 10 and the sewn stocking blank is everted as it is drawn through the carrier tube 10 so that the sewn toe seam is on the inside of the hosiery blank and the hosiery blank is in a right side out condition. The closed toe hosiery blank is then discharged through a delivery tube 20 (FIG. 1) supported on the machine housing 12. Thus, the conventional use of this type of automatic toe closing machine requires that the operator manually don the hosiery blanks on successive hosiery carriers and the hosiery carriers are then moved past a sewing machine where the toe end is automatically closed.

In accordance with the present invention, this conventional type of automatic toe closing machine has been modified to provide a hosiery donning device positioned at the hosiery receiving station for automatically drawing successive hosiery blanks onto the hosiery carriers as they move into position at the hosiery receiving station. A hosiery blank slitting device is also provided at the hosiery receiving station and is operable in response to movement of the hosiery donning device for longitudinally slitting the leading end of the hosiery blank as it is automatically drawn onto the hosiery carrier. The addition of the hosiery donning device and the hosiery slitting device results in the automatic drawing of the hosiery blank into the proper position on the hosiery carrier so that the proper length of slit is formed in successive hosiery blanks.

When the hosiery blank has been drawn onto the hosiery carrier at the hosiery donning station and the slit formed in the upper end thereof, the hosiery carrier continues to move in a step-by-step manner around the endless path and the machine operates in the conventional manner to seam the toe end closed at the sewing machine 14 and then doff the hosiery blank from the hosiery carrier by withdrawing it with suction currents through the center of the hosiery carrier to evert the same back to a right side out condition so that the sewn toe seam is on the inside of the hosiery blank. The toe closing machine is provided with a conventional feed roller 22 (FIGS. 4 and 5) which operates to engage the hosiery blank on the carrier tube 10 and cooperates with the spreading fins 15, 16 to properly position the toe end of the blank for trimming and sewing by the sewing machine 14 as it passes thereby.

Hosiery Donning Device

Figure 9:
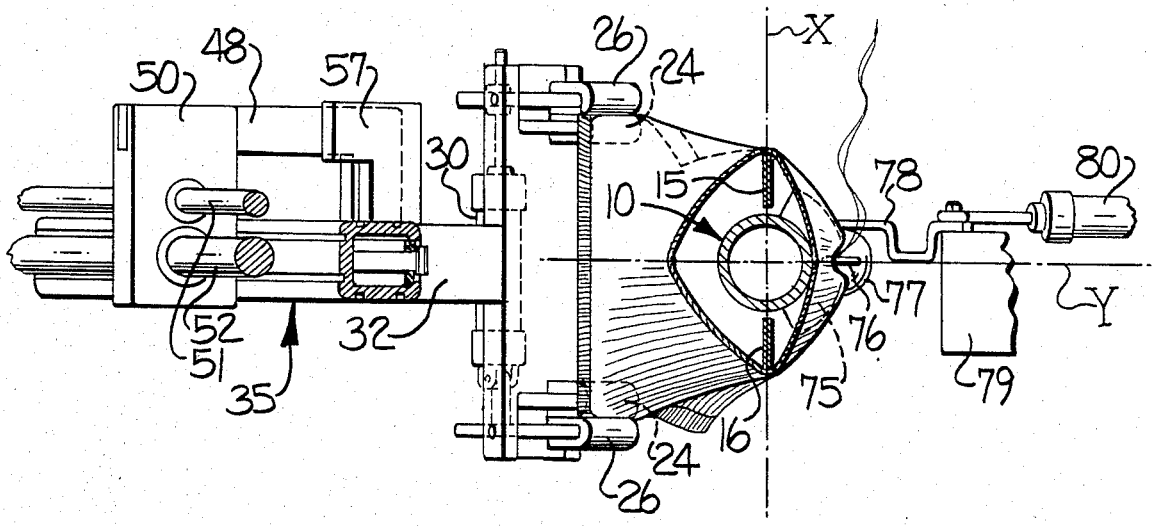
FIG. 9 is an enlarged vertical sectional view taken substantially along the line 9—9 in FIG. 8.

The automatic hosiery donning device includes a pair of inner gripping fingers 24 (FIG. 7) which are provided at their forward free ends with pads of cushioning frictional gripping material and their inner or rear ends are fixed to a vertical support bar 25. Stop guides 23 are supported on and extend outwardly from the gripping fingers 24 to aid the operator in positioning the upper end of the hosiery blank thereon. The inner gripping fingers 24 are spaced apart vertically a sufficient distance that the upper or welt end of the hosiery blank may be turned back and positioned thereon by an operator, as illustrated in FIG. 6. The forward ends of upper and lower movable gripper fingers 26 (FIG. 7) are normally spaced above and below the forward ends of the fixed gripper fingers 24 and their medial portions are pivotally supported on the vertical support bar 25. The forward ends of the movable gripper fingers 26 are also provided with pads of cushioning frictional material. The rear ends of the movable gripper fingers 26 are connected to opposite ends of a hydraulic cylinder 30. At the beginning of the donning cycle, the piston rod of the cylinder 30 is moved outwardly to move the movable gripping fingers 26 into engagement with the upper end of the hosiery blank and grip the same against the fixed inner gripping fingers 24, as illustrated in FIG. 9.

Figure 2:
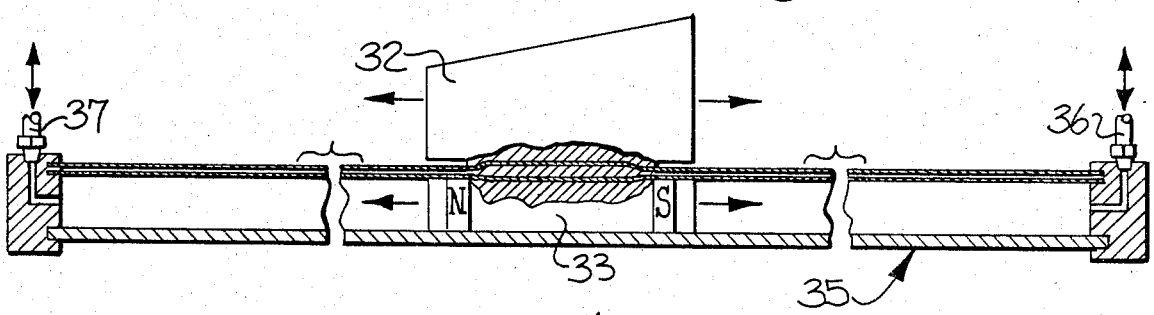
FIG. 2 is a somewhat schematic longitudinal sectional view through the rodless hydraulic cylinder for operating the hosiery donning device.
Figures 4, 5:
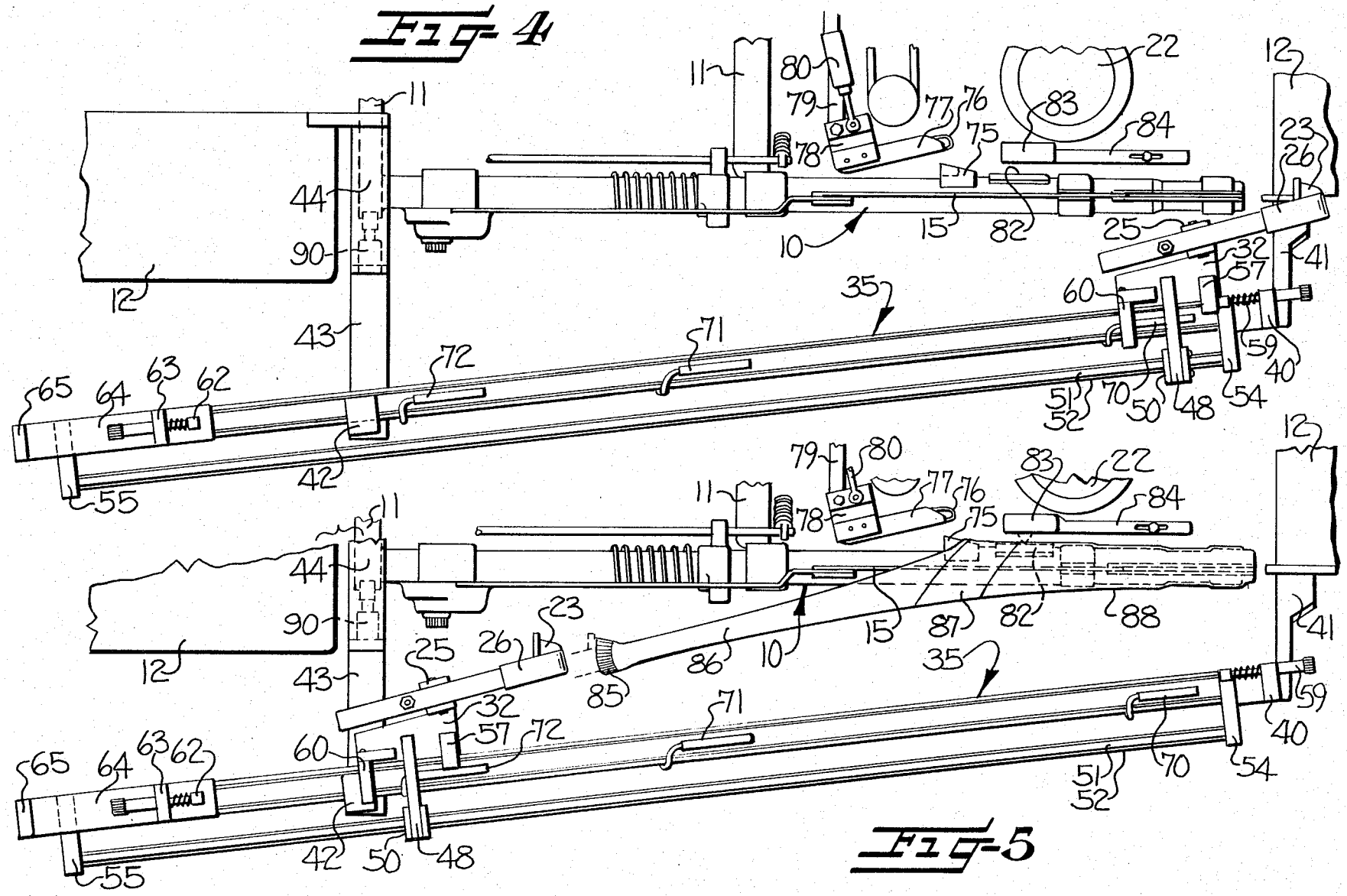
FIG. 4 is a fragmentary plan view looking downwardly on the hosiery donning device and being taken substantially in the direction of the arrow 4 in FIG. 1.
FIG. 5 is a view similar to FIG. 4 and illustrating the position of the parts of the hosiery donning device when the longitudinal slit has been completed.

The medial portion of the vertical support bar 25 is fixed to the outer surface of a slide plate 32 (FIG. 7) which is fixed on its inner surface to the operating piston 33 (FIG. 2) of a rodless pneumatic cylinder, broadly indicated at 35. This rodless pneumatic cylinder 35 is of the type currently being sold by Origa Corporation, of Elmhurst, Ill. and disclosed in U.S. Pat. No. 3,820,446. Opposite ends of the rodless pneumatic cylinder 35 are connected to air pressure supply lines 36, 37 (FIG. 2) and through a suitable valve, not shown, to a source of compressed air so that air can be introduced under pressure to either end of the rodless cylinder 35 and cause the operating slide bar 32 to move between opposite ends of the rodless cylinder 35, thereby moving the gripper fingers 24, 26 and the upper end of the hosiery blank along a path of travel adjacent the carrier tube 10 to draw successive hosiery blanks onto the hosiery carrier 10, as illustrated in FIGS. 4 and 5.

Figure 7:
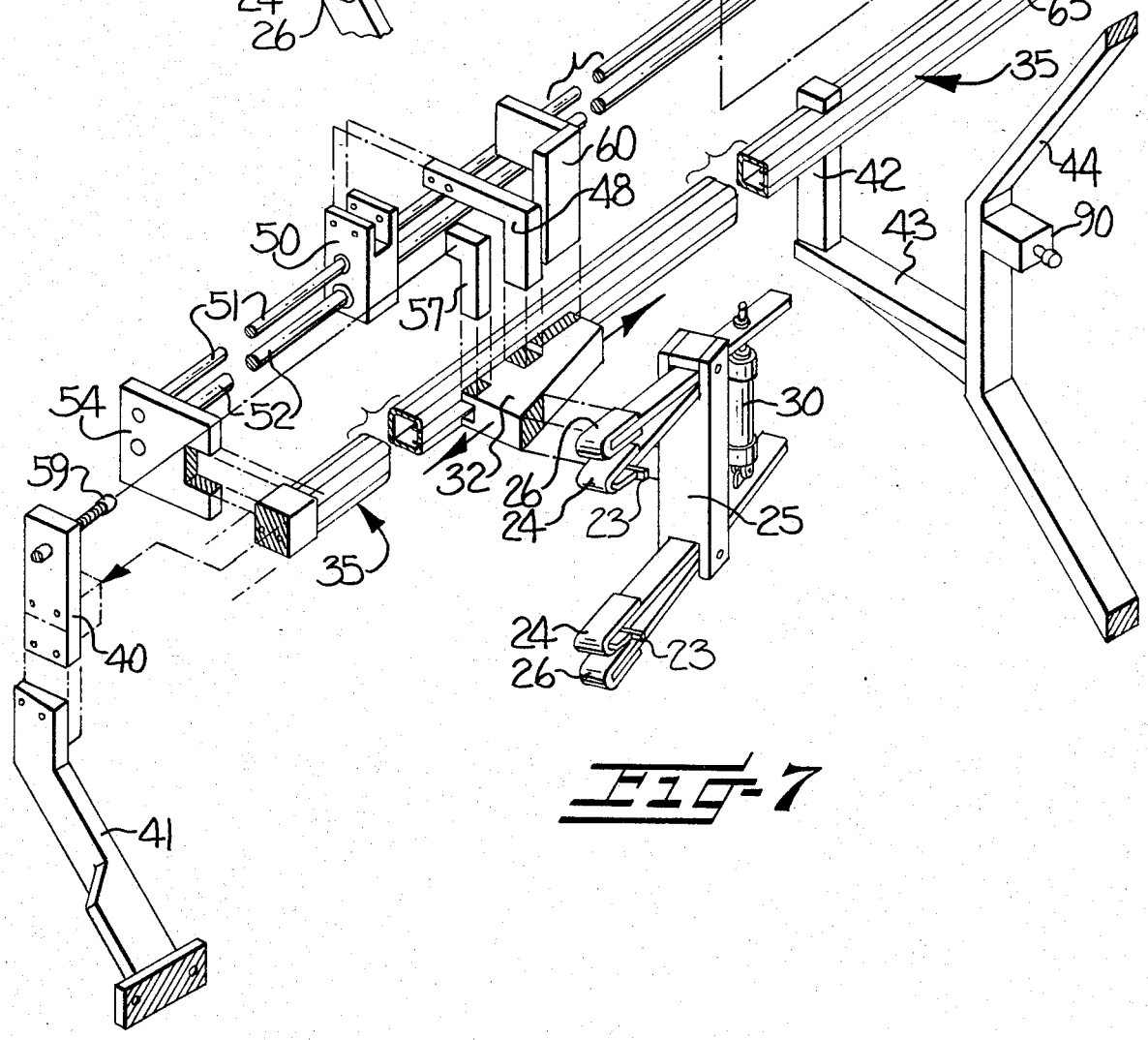
FIG. 7 is an exploded isometric view illustrating the parts of the donning device and the manner in which it is supported on the automatic toe closing machine.

As illustrated in FIG. 7, the forward end of the rodless cylinder 35 is mounted on a vertical support plate 40, the lower end of which is fixed on the upper end of a support bracket 41, fixed at its lower end to the toe closer machine housing 12. A vertical support bracket 42 is fixed at its upper end to the rodless cylinder 35 at a position spaced from the rear end of the cylinder 35 and the lower end thereof is supported on a horizontal brace 43. The inner end of the brace 43 is fixed on the medial portion of a support bracket 44 which is in turn fixed at its upper and lower ends to the toe closer machine housing 12.

Means is provided for guiding and supporting the slide plate 32 and the hosiery grippers 24, 26 and associated parts and includes a bridging bracket 48 (FIG. 7), the lower inner end of which is fixed on the slide plate 32 and the outer end of which is fixed in the upper end of a guide block 50 supported for sliding movement on upper and lower guide rods 51, 52. The forward ends of the guide rods 51, 52 are fixed in a support plate 54 fixed on the forward end of the mounting block of the rodless cylinder 35. The rear end of the guide rods 51, 52 are fixed in a rear support plate 55 which is in turn fixed on the rear mounting block of the rodless cylinder 35.

A forward limit stop plate 57 is supported at its lower end on the forward end of the slide plate 32 and its upper end is adapted to engage an adjustable stop 59 threadably supported in the upper end of the support plate 40. A rear limit stop plate 60 is fixed at its lower end to the rear portion of the slide plate 32 and its upper end is adapted to engage an adjustable rear stop 62 which is supported in a stop plate 63. The stop plate 63 is mounted for longitudinal adjustment on a horizontal support plate 64 fixed on a vertical plate 65 attached to the rear mounting block of the rodless cylinder 35. Magnetic reed switches 70, 71 and 72 are provided on the upper surface of the rodless cylinder 35 and are properly positioned to control various functions of the donning device, in a manner to be presently described. Similar reed switches, not shown, are mounted on the lower surface of the rodless cylinder 35 and beneath the reed switches 70, 71 to insure proper detection of the movement of the magnets on the piston 33.

Slitting Device

Figure 3:
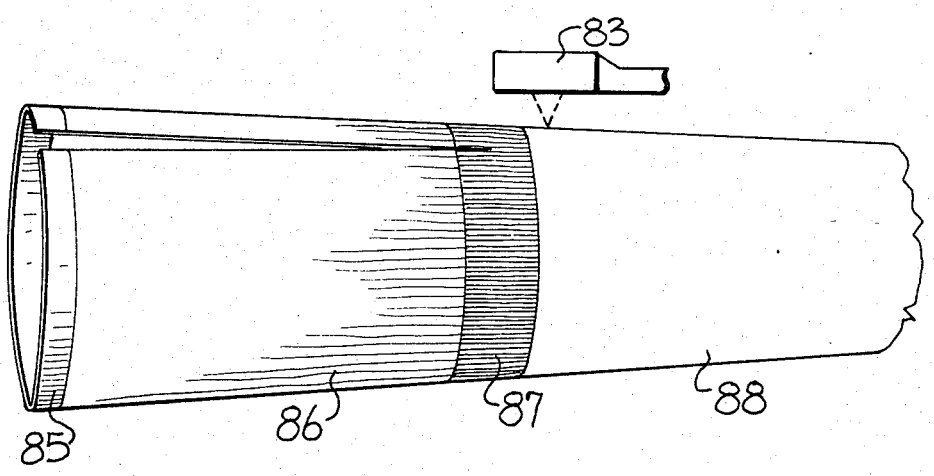
FIG. 3 is an elevational view of the upper portion of a hosiery blank and schematically illustrating how the photo cell detects the presence of the sheer leg portion in order to terminate the formation of the longitudinal slit at the proper position.

The inner surface of each of the tubular hosiery carrier tubes 10 is provided with a semi-conical hosiery guide 75 which tapers outwardly toward the rear or inner end of the hosiery carrier 10 for engaging and guiding the leading end of the hosiery blank into a hot wire cutter or slitter 76 (FIGS. 4, 5, 6 and 8). The hosiery guide 75 is fixed to the inner surface of the hosiery carrier tube 10 and includes a rearwardly facing slot into which the heated wire cutter 76 moves and is positioned as the hosiery blank is drawn onto the carrier tube 10 by the donning device to form a longitudinal slit in the upper portion of the hosiery blank, extending from the upper free end and therealong, as illustrated in FIG. 3. The hot wire slitter 76 is mounted in the forward end of a smoothly curved support mounting bar 77. The rear end of the mounting bar 77 is fixed to a pivot bracket 78 which is pivotally supported on one end of a support bar 79 (FIG. 6). The piston rod of a pneumatic cylinder 80 is attached to the support bracket 78 and is operated in the proper timed sequence to move the heated wire cutter 76 between the active or cutting position illustrated in FIG. 8 and the inactive or noncutting position illustrated in FIGS. 4–6.

Detector Device

Detector means is provided for moving the hot wire cutter 76 out of cutting position when the proper length of slit has been formed in the hosiery blank and includes a smooth faced reflector bar 82 fixed on the inner surface of each of the hosiery carriers 10 and forwardly of the hosiery guide 75 (FIG. 6). A photocell detector 83 is supported on a longitudinally adjustable support arm 84 (FIGS. 4 and 5) and is operated by the hosiery blank as it is drawn onto the carrier tube to terminate operation of the slitting device when the hosiery blank has been drawn onto the hosiery carrier tube 10 to the proper position.

As illustrated in FIG. 3, the upper end of the hosiery blank is provided with a turned welt portion 85 and a panty portion 86, both of which are normally knit of a heavy denier yarn. A nonrun band 87, also knit of a relatively heavy denier yarn, is provided adjacent the panty portion 86 and a sheer leg portion 88, knit of a fine denier yarn, extends below the nonrun band 87. As the hosiery blank is drawn onto the hosiery carrier tube 10, the hot wire slitter 76 is positioned in the operative position illustrated in FIGS. 8 and 9 and the hosiery blank is slit as it is guided up over the hosiery guide 75 and into contact with the heated wire 76 until the sheer leg portion 88 is detected by the photocell detector 83. This actuates the pneumatic cylinder 80 to move the heated wire 76 to the inoperative position and stop the formation of the slit at a point adjacent the upper edge of the nonrun band 87 of the hosiery blank, as illustrated in FIG. 3.

A safety switch 90 (FIGS. 4, 5 and 7) is supported on the inner surface of the support bracket 44 and in position to be engaged by the inner end of each carrier tube 10 as it moves into position at the hosiery receiving station. This safety switch 90 is provided to prevent operation of the hosiery donning device and the slitting device except when one of the carrier tubes 10 is properly positioned at the hosiery receiving station.

Operation

The hosiery carrier tubes 10 may be moved around the endless oblong path of travel in a step-by-step manner in accordance with a timed sequence. However, it is preferred that each step of movement be controlled by a foot pedal switch, not shown, actuated by the operator. As successive hosiery carriers 10 move into the donning position at the forward side of the toe closing machine, the operator merely places the open toe end of the right side out hosiery blank into the open end of the carrier tube 10 so that it is drawn into the tube by suction currents with the toe end being first drawn into the tube 10. The operator then folds the welt portion 85 of the hosiery blank inwardly and places it on the fixed fingers 24 with the edge of the hosiery blank against the stop members 23, as illustrated in FIG. 6. The piston rod of the cylinder 30 is then moved outwardly to bring the movable gripper fingers 26 into clamping engagement with the gripper fingers 24 to hold the welt 85 positioned therebetween. Air pressure is then directed into the forward end of the rodless cylinder 35 to begin moving the piston 33 rearwardly, thereby moving the gripper fingers 24, 25 and the upper end of the hosiery blank along the hosiery carrier tube 10, thereby drawing the hosiery blank out of the tube 10 and everting the hosiery blank from a right side out to a wrong side out condition. As the piston 33 passes the upper and lower reed switches 71, the suction is turned off, during the formation of the longitudinal slit. The welt 85 and panty portion 86 are slit by the heated wire 76 positioned in the slot in the guide 75.

Figure 8:
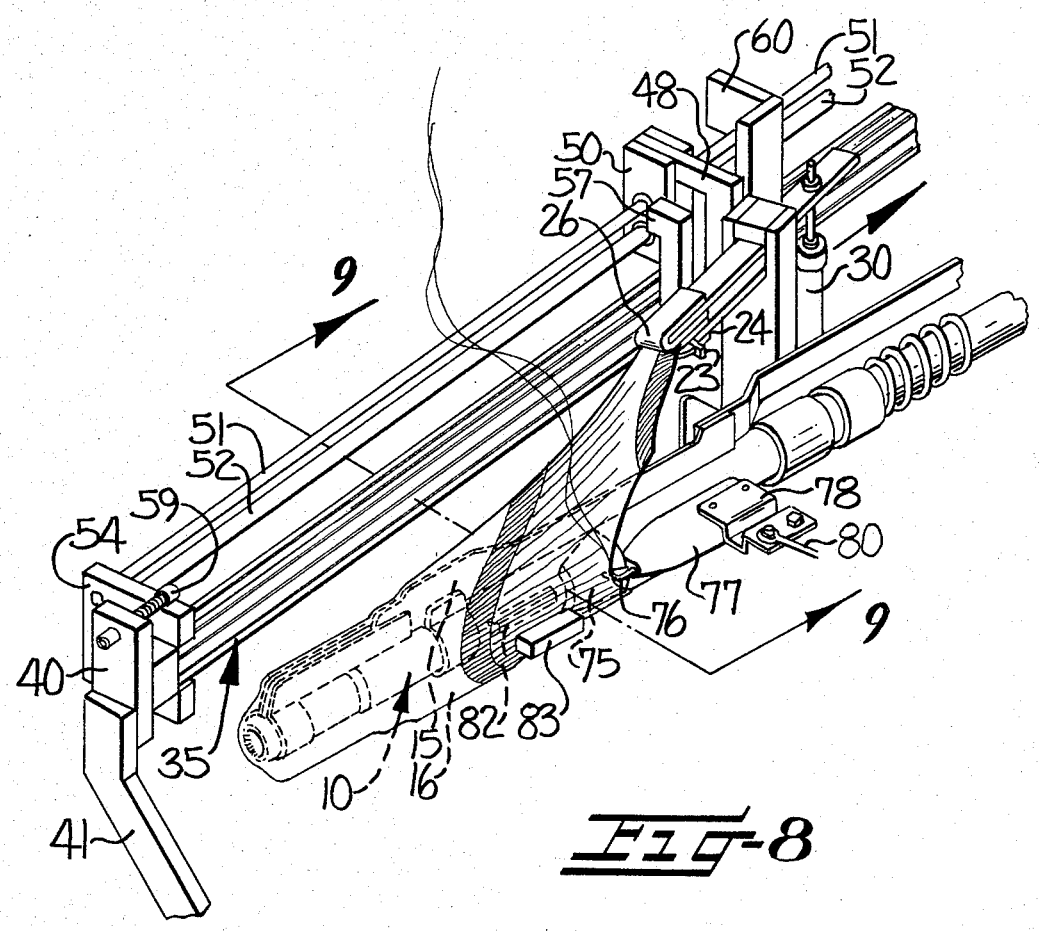
FIG. 8 is a view similar to FIG. 6 but illustrating the leading end of the elongate hosiery blank being drawn onto the hosiery carrier and the longitudinal slit being formed by the heated wire cutter.

While the hosiery blank is being slit by the heated wire 76, as illustrated in FIG. 8, the toe end portion of the hosiery blank is being drawn out of the hosiery carrier tube 10. When the nonrun band 87 passes beyond the photocell detector 83, the piston rod of the cylinder 80 is drawn inwardly to pivot the heated wire 76 outwardly to inoperative position out of engagement with the hosiery blank to terminate the formation of the slit in the hosiery blank. When the slit is completed, the piston rod of the cylinder 30 is drawn inwardly to release the gripper fingers 26 so that the upper end of the hosiery blank is released, as illustrated in FIG. 5. The upper and lower reed switches 72 reverse the movement of the piston 33 in the rodless cylinder 35 so that the gripper fingers 24, 26 move back to the donning position at the forward end of the rodless cylinder 35 and are positioned to again receive the leading end of a hosiery blank.

The hosiery carrier tube 10, with the slit hosiery blank thereon, in wrong side out condition, then starts its movement to the seaming position toward the sewing machine 14. The feed wheel 22 moves inwardly against the hosiery blank and 12 rotates to properly position the toe end portion of the hosiery blank on the carrier tube 10 and the spreader fins 15, 16 are actuated to flatten the toe end of the hosiery blank for movement by the sewing machine to trim and seam the open toe closed. At the same time, another hosiery carrier tube 10 is moved into the donning position and a hosiery carrier tube 10 moves into the doffing position so that the hosiery blank thereon is withdrawn through the hosiery carrier 10 and everted back to the right side out condition with the seam on the inside of the toe of the hosiery blank. The slit and toe closed hosiery blanks are then transported to another station where the slit edges of the pantry of adjacent hosiery blanks are seamed together to complete the formation of the pantyhose.

In accordance with the present invention, the operator is only required to place the toe end of the hosiery blank into the carrier tube and the upper or welt end in the gripper fingers of the donning device. The hosiery blank is then automatically drawn onto the hosiery carrier tube and slit at its upper end. The hosiery blanks are then seamed at the toe end and discharged from the automatic toe closing machine. Thus, the donning, slitting and toe closing operations are automatically carried out in one continuous operation to thereby reduce the cost of producing the pantyhose, and to also reduce the number of picks and snags which can be caused by multiple handling operations.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In an automatic hosiery toe closing machine including a plurality of elongate tubular hosiery carriers movable around an endless path, a toe seamer positioned at a fixed location adjacent the path of travel of said hosiery carriers, and a hosiery receiving station positioned in advance of said seamer location, the combination therewith of (a) hosiery donning means positioned at said hose receiving station for automatically drawing successive hosiery blanks onto successive ones of said hosiery carriers as they move to said hosiery receiving station, and (b) slitting means associated with said hosiery receiving station and being operable in response to movement of said hosiery donning means for longitudinally slitting the leading end of the hosiery blank as it is automatically drawn onto said hosiery carrier.

2. A hosiery toe closing machine according to claim 1 wherein said hosiery donning means comprises hosiery gripping fingers, and means supporting said hosiery gripping fingers for movement along said hosiery carrier at said hosiery receiving station, and means for moving said hosiery gripping fingers longitudinally of said hosiery carrier for drawing a hosiery blank onto said hosiery carrier.

3. A hosiery toe closing machine according to claim 2 wherein said hosiery gripping fingers include an inner pair of vertically spaced gripper fingers, means supporting said inner pair of gripper fingers in a fixed position, an outer pair of movable gripper fingers positioned above and below said inner pair of gripper fingers, and operator means associated with said outer pair of gripper fingers for selectively moving said outer pair of movable gripper fingers into and out of gripping relationship with said inner pairs of gripper fingers.

4. A hosiery toe closing machine according to claim 3 wherein said operator means comprises a hydraulic cylinder attached at opposite ends to said outer pair of movable gripper fingers and operable to move said movable gripper fingers toward and away from each other.

5. A hosiery toe closing machine according to claim 2 wherein said moving means comprises a hydraulic rodless cylinder including a longitudinally movable piston therein, and means drivingly connecting said gripping fingers to said piston for movement therewith.

6. A hosiery toe closing machine according to claim 5 wherein said supporting means comprises guide rod means extending parallel to said rodless cylinder, a guide member supported for sliding movement on said guide rod means, and bridging means connecting said guide member and said means drivingly connecting said gripping fingers to said piston.

7. A hosiery toe closing machine according to claim 1 wherein said slitting means comprises a hot wire, means mounting said hot wire for movement between an operative position adjacent said hosiery carrier and an inoperative position away from said hosiery carrier, and operator means for moving said hot wire between said operative and inoperative positions.

8. A hosiery toe closing machine according to claim 7 wherein said operator means comprises a pneumatic cylinder operatively connected to said mounting means for said hot wire.

9. A hosiery toe closing machine according to claim 7 including a semi-conical guide fixed on said hosiery carrier for guiding the hosiery blank into said hot wire when positioned in the operative position.

10. A hosiery toe closing machine according to claim 1 including detector means positioned adjacent said hosiery carrier and being operable by the hosiery blank being drawn on said hosiery carrier to terminate operation of said slitting means after a predetermined length of the hosiery blank had been drawn onto said hosiery carrier and slit.

11. A hosiery toe closing machine according to claim 10 wherein said detector means comprises a photocell supported adjacent said hosiery carrier and being operable to detect the presence of the sheer leg portion of the hosiery blank and to terminate operation of said slitting means upon such detection.

12. In an automatic hosiery toe closing machine for processing hosiery blanks in preparation for forming pantyhose therefrom, the hosiery blanks each including a panty portion knit of a heavy denier yarn and a leg portion knit of a light denier yarn, said machine including a plurality of elongate tubular hosiery carriers movable around an endless path, a toe seamer positioned at a fixed location adjacent the path of travel of said hosiery carriers, and a hosiery receiving station positioned in advance of said seamer location, the combination therewith of (a) hosiery donning means positioned at said hosiery receiving station for automatically drawing successive hosiery blanks onto successive ones of said hosiery carriers as they move to said hosiery receiving station, the hosiery blanks being drawn onto said hosiery carriers with the panty portion of the leading end thereof, (b) slitting means associated with said hosiery receiving station and being operable in response to movement of said hosiery donning means for longitudinally slitting the leading end of the hosiery blank as it is automatically drawn onto said hosiery carrier, and (c) detector means positioned adjacent said hosiery carrier and in advance of said slitting means, said detector means being operable to terminate said slitting means when the leg portion of the hosiery blank passes said detector means.

13. A method of processing hosiery blanks on an automatic hosiery toe closing machine in preparation for forming pantyhose therefrom, said toe closing machine including a plurality of elongate tubular hosiery carriers movable around an endless path, a toe seamer positioned at a fixed location adjacent the path of travel of said hosiery carriers, a hosiery receiving station positioned in advance of said seamer location, hosiery donning means positioned at said hosiery receiving station, and slitting means associated with said hosiery receiving station, said method comprising the steps of (a) positioning the leading end of successive hosiery blanks on said hosiery donning means to automatically draw successive hosiery blanks onto successive ones of said hosiery carriers as they move to said hosiery receiving station, and (b) slitting the leading end of successive hosiery blanks as the leading end of the hosiery blank is drawn onto said hosiery carrier by said hosiery donning means.

14. A method according to claim 13 wherein each hosiery blank includes a panty portion knit of a heavy denier yarn and a leg portion knit of a light denier yarn, and wherein said method includes the step of detecting the drawing of the leg portion past a location on said hosiery carrier and terminating the operation of said slitting means upon such detection.

* * * * *